US006327746B1

(12) United States Patent
Barauke

(10) Patent No.: US 6,327,746 B1
(45) Date of Patent: Dec. 11, 2001

(54) ENDLESS TRANSPORT BELT FOR TRANSPORTING A DRAFTED FIBER STRAND AND METHOD OF MAKING SAME

(75) Inventor: Norbert Barauke, Donzdorf (DE)

(73) Assignee: Spindelfabrik Suessen, Schurr, Stahlecker & Grill GmbH, Suessen (DE)

( * ) Notice: Subject to any disclaimer, the term of this patent is extended or adjusted under 35 U.S.C. 154(b) by 0 days.

(21) Appl. No.: 09/362,743

(22) Filed: Jul. 29, 1999

(30) Foreign Application Priority Data

Aug. 17, 1998 (DE) ..... 198 37 183

(51) Int. Cl.[7] ..... D01H 5/86

(52) U.S. Cl. ..... 19/246; 19/150; 19/244

(58) Field of Search ..... 19/244, 288, 150, 19/236, 246, 237, 238, 239, 255, 240, 241, 242, 243, 245, 247, 248, 249, 250, 252, 286, 287, 263, 304, 305, 306, 307, 308; 198/689.1, 846; 162/358.2, 900, 903, 904; 156/137–139, 143; 226/95, 170–172

(56) References Cited

U.S. PATENT DOCUMENTS 3,770,374 * 11/1973 Fleissner ..... 8/149.3
3,851,681 * 12/1974 Egan ..... 139/420 R
3,889,801 * 6/1975 Boyer ..... 198/184
3,915,202 * 10/1975 Curtis et al. ..... 139/425 A
3,924,297 * 12/1975 Ingham, Jr. ..... 19/255
4,350,731 * 9/1982 Siracsano ..... 428/234
4,485,528 * 12/1984 Anahara et al. ..... 19/288
4,692,967 * 9/1987 Dolan et al. ..... 19/244
4,984,772 * 1/1991 Freund ..... 19/163
5,042,112 * 8/1991 Stahlecker ..... 19/252
5,062,220 * 11/1991 Keilhack ..... 34/155
5,600,872 2/1997 Artzt et al. ..... 19/244
5,699,707 * 12/1997 Campbell, Jr. ..... 198/689.1
6,032,789 * 3/2000 Mayer et al. ..... 198/819

* cited by examiner

*Primary Examiner*—John J. Calvert
*Assistant Examiner*—Gary L. Welch
(74) *Attorney, Agent, or Firm*—Crowell & Moring LLP

(57) ABSTRACT

An endless transport belt transports a drafted fiber strand through a fiber bundling zone. The transport belt is provided with a perforation for a suction air stream which suctions the fiber strand. The transport belt is provided with a sufficiently smooth surface for sliding over a suction device. The transport belt can be in the form of an endless woven or knitted sieve belt or alternatively in the form of an extruded plastic apron having punched out holes.

18 Claims, 3 Drawing Sheets

ENDLESS TRANSPORT BELT FOR TRANSPORTING A DRAFTED FIBER STRAND AND METHOD OF MAKING SAME

BACKGROUND AND SUMMARY OF THE INVENTION

This application claims the priority of German application 198 37 183.7, filed in Germany on Aug. 17, 1998, the disclosure of which is expressly incorporated by reference herein.

The present invention relates to an endless transport belt for transporting a drafted fiber strand though a fiber bundling zone, said transport belt comprising a perforation for an air suction stream which suctions the fiber strand as well as a sufficiently smooth surface on the inside for sliding over a suction device.

A transport belt of this type is prior art in US Pat. No. 5,600,872. It is produced in the way of a drafting apron of spinning machines, but more flexible, in that for example it has no woven insert. In addition, it is perforated for the purpose of suctioning the fiber strand, whereby the holes are arranged in one row in a fiber strand transport direction. The perforated apron slides over a suction device and is driven by means of a delivery roller.

It is an object of the present invention to produce a transport belt of the above mentioned type, which, with regard to the fiber bundling, is particularly favorably designed.

This object according to the present invention has been achieved in that in one embodiment the transport belt is a woven or knitted sieve belt, and in a second embodiment it is an extruded plastic apron with punched out holes.

The embodiment of the transport belt according to the present invention in the form of a woven or knitted sieve belt has the advantage in that on the one hand the perforations occur, so to speak, of their own accord, and on the other hand in that the perforations in transport direction are at absolutely identical distances from one another. The latter is very important for spinning a high quality yarn.

The sieve belt is advantageously produced from synthetic filaments, for example a polyamide. This has the advantage that the edges of the sieve belt can be welded. The diameter of the synthetic filaments should preferably measure less than 0.1 mm; the mesh width should also measure less than 0.1 mm. It has been shown that the more close-perforated the sieve belt is, the better the spinning results.

When the transport belt takes the form of an extruded plastic apron, it is necessary to punch out the holes. In order to reduce time and cost, a single row of holes suffices, which is adapted to the width of the fiber strand. The holes should have a diameter of approximately 0.6 to 1.0 mm.

When the extruded plastic apron is guided only on its inner side on a sliding guide and driven on its outer side, it is practical to provide two layers. The inner layer of the plastic apron should be particularly friction-free, so that the inner surface can slide efficiently over the suction device. PTFE is here an advantageous option. In contrast, the outer layer should be relatively stable in form, so that it can cope with the friction drive to be generated.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
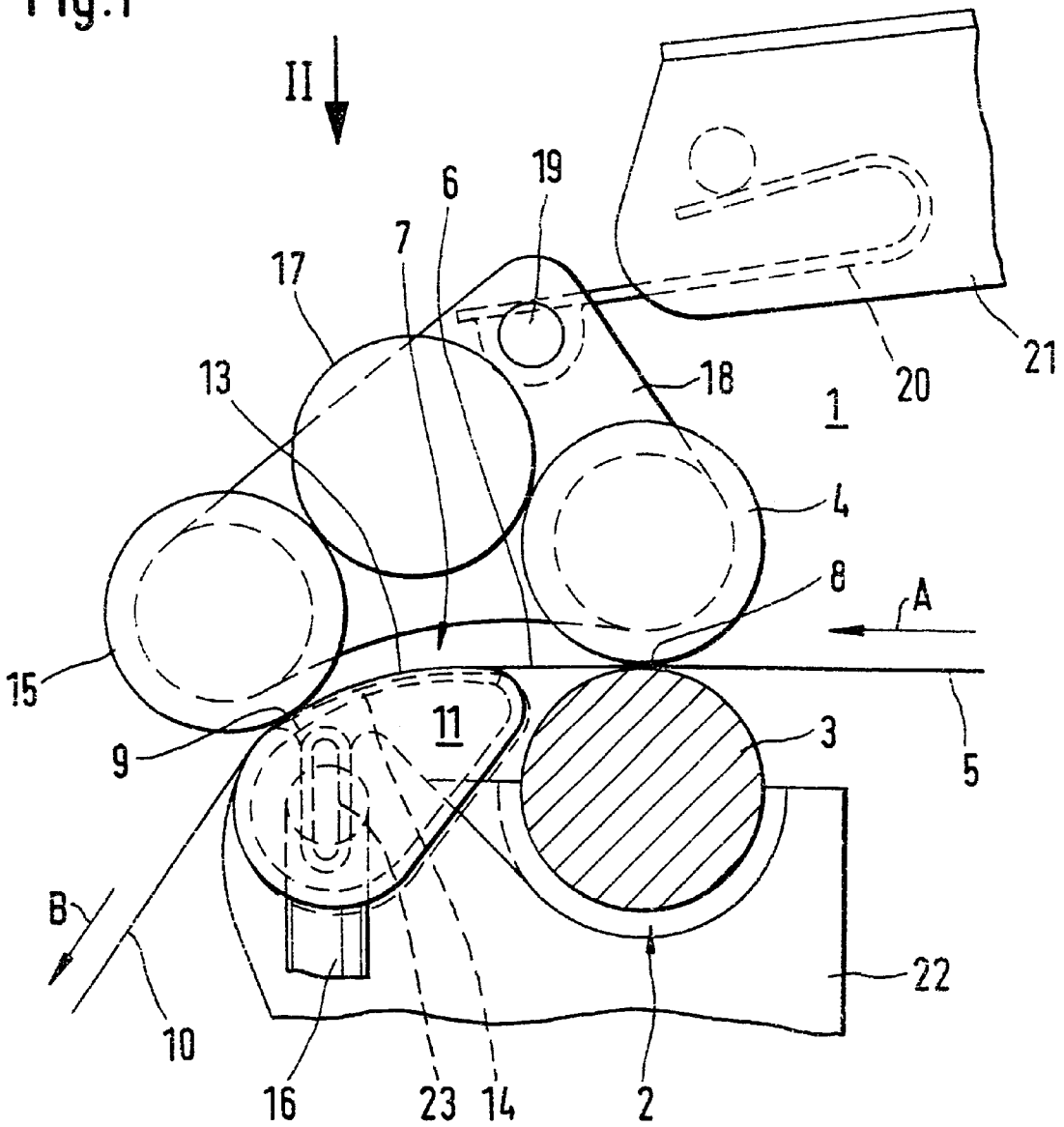
FIG. 1 is a part sectional side view of a fiber bundling zone arranged downstream of a drafting arrangement, in which fiber bundling zone an endless transport belt according to the present invention is applied.

In FIG. 1, which applies to all embodiments of the transport belt 13 according to the present invention, only the area of the front roller pair 2 of a drafting arrangement 1 is shown. The front roller pair 2 comprises a driven bottom cylinder or roller 3 extending in a machine longitudinal direction, as well as a top roller 4 pressed flexibly thereto. The sliver or roving 5 is guided in the sliver transport direction A through the drafting arrangement 1 and is thus drafted in the known way.

From the point of the front roller pair 2 onwards, there exists a ready drafted fiber strand 6, which however, travels through a fiber bundling zone 7. In this fiber bundling zone 7, the fiber strand 6 should be condensed in such a way that the edge fibers are wrapped around the core of the fiber strand 6. Thus a better substance utilization is achieved for the yarn 10 to be spun, which means a higher tear resistance and reduced hairiness.

The fiber bundling zone 7 is located between the nipping point 8 of the front roller pair 2 as well as nipping point 9 arranged further downstream, from which point on the yarn 10 receives its spinning twist and is fed direction B to a twisting device (not shown), for example a ring spindle.

A suction device 11 is arranged at the fiber bundling zone 7, which suction device 11 consists essentially of a hollow profile 12. The surface of the hollow profile 12 serves as a sliding guide for a perforated transport belt 13, which is designed in an endless form and which travels around the suction device 11. This transport belt 13 serves to transport the fiber strand 6 to be bundled through the fiber bundling zone 7.

The hollow profile 12 comprises on its side facing away from the fiber strand 6 a suction slit 14 extending in the transport direction A for a suction air stream to be sucked in. The suction slit 14 is somewhat wider than the fiber strand 6 and can taper somewhat in transport direction A, corresponding to the increasing condensing of the fiber strand 6. The suction slit 14 extends to the nipping point 9. If required the suction slit 14 can be arranged slightly slanted in the transport direction A nipping roller 15 presses onto the hollow profile 12, said nipping roller 15 thus forming, together with the suction device 11, the nipping point 9. The nipping roller 15 drives hereby the transport belt 13 in transport direction A, whereby the inner surface of the transport belt 13 is guided on the hollow profile 12. The suction device 11 itself is connected to a vacuum source (not shown) by means of a suction air conduit 16.

The nipping roller 15, whose peripheral speed practically corresponds to that of the top roller 4, is driven by the drafting arrangement 1 by means of a transfer roller 17 in a way not further shown. The top roller 4 as well as the nipping roller are arranged in a rocker 18, which can be swivelled around a swivel axle 19. The rocker 18 hangs on a loading spring 20, which loads the top roller 4 as well as the nipping roller 15 in the respective nipping points 8 and 9. The loading spring 20 is in turn arranged in a loading support 21 of the drafting arrangement 1.

Further in FIG. 1, a roller stand for the bearing of the bottom cylinder 3 can be seen, also a supporting surface 23, with which the hollow profile 12 is disposed in a guide of the roller stand 22.

Figure 2A:
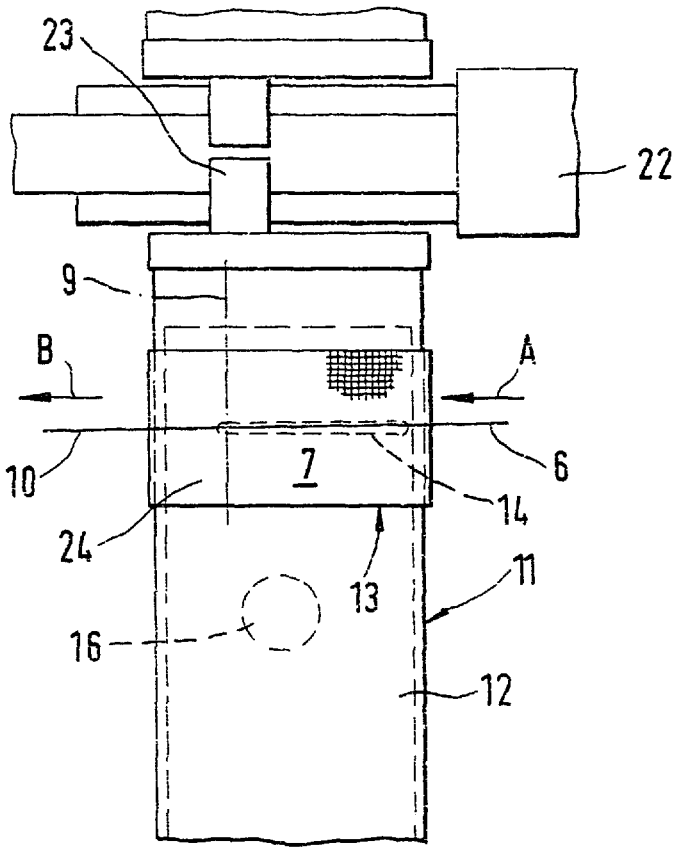
FIG. 2A is a view in the direction of the arrow 11 of FIG. 1 onto a transport belt guided over a suction device, said transport belt being designed as a woven or knitted sieve belt.
Figure 2B:
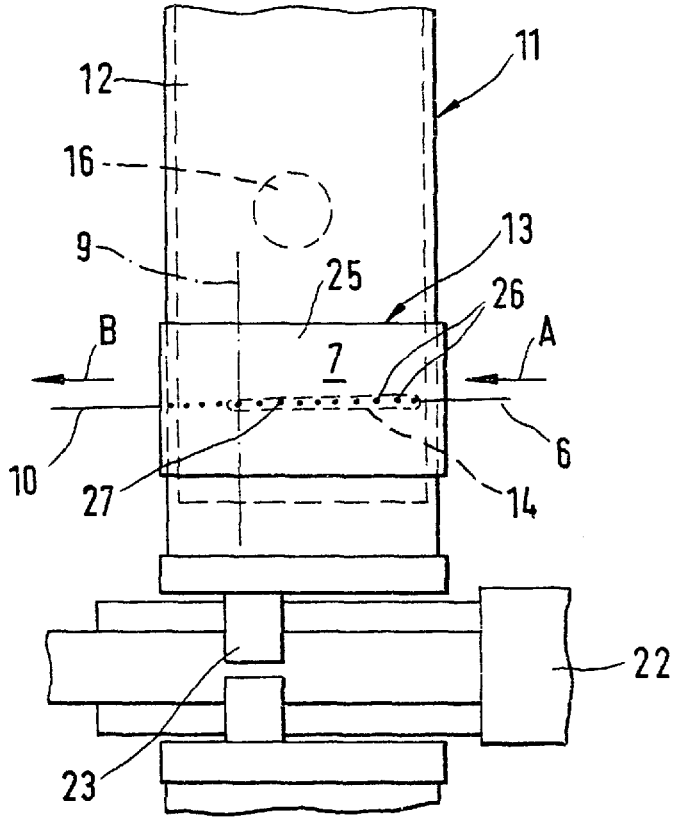
FIG. 2B is a view corresponding to FIG. 2A, whereby the transport belt is designed as an extruded plastic apron having one row of punched out holes.

The FIGS. 2A and 2B differ from each other only in that two different embodiments of a transport belt 13A, 13B are provided. To the extent the reference numbers are identical with those in FIG. 1, the FIGS. 2A and 2B do not need to be separately described.

The transport belt 13A according to FIG. 2A consists of a woven or knitted finely perforated sieve belt 24, in which the perforations occur of their own accord.

Go The transport belt 13B according to FIG. 2B consists of an extruded plastic apron 25 with only one centrical row of holes 26 made from punched out holes 27.

Figure 3:
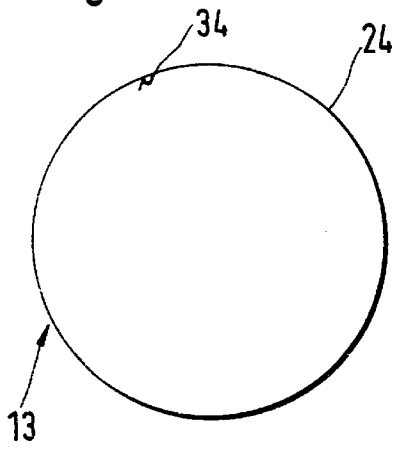
FIG. 3 is a side view of a sieve belt according to FIG. 2A.
Figure 4:
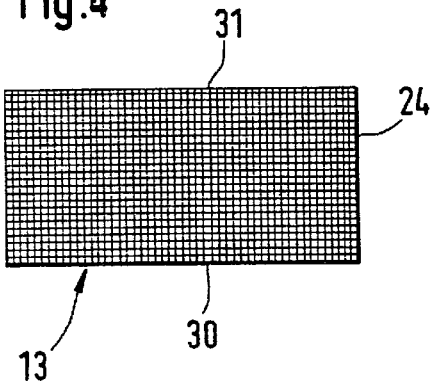
FIG. 4 is a top view of a sieve belt of FIG. 3.
Figure 5:
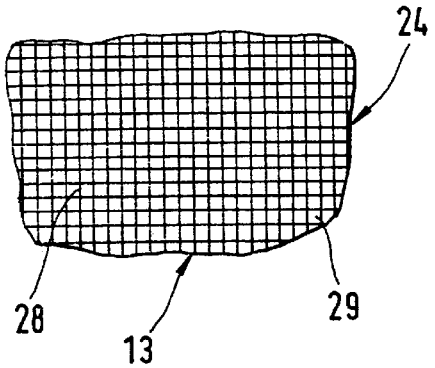
FIG. 5 is a section of FIG. 4 in greatly enlarged dimensions.

The sieve belt 24 according to the arrangement in FIGS. 1 and 2A is shown in more detail in the FIGS. 3 to 5. In particular in FIG. 5, the individual synthetic filaments 28 can be seen, which each have a diameter in the order of 0.06 to 0.2 mm. In the case of such a woven or knitted material, the mesh width 29 (space between filaments) should lie below 0.3 mm, preferably below 0.1 mm. If, for example, the synthetic filaments are made from a formable polyamide, the edges 30 and 31 can be welded. In the case of such a sieve belt 24, the inner surface 34 is naturally sufficiently smooth so that the sieve belt 24 can be guided over the suction device 11.

Figure 6:
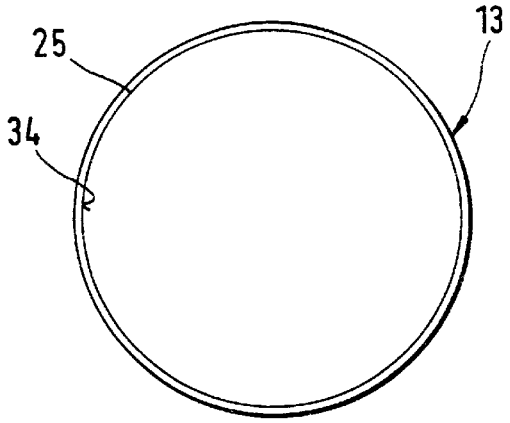
FIG. 6 is a side view of an extruded plastic apron according to FIG. 2B.
Figure 7:
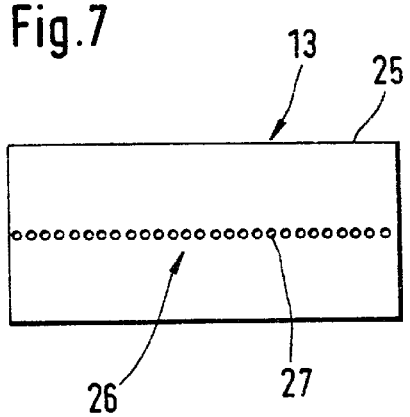
FIG. 7 is a top view onto the plastic apron in FIG. 6.
Figure 8:
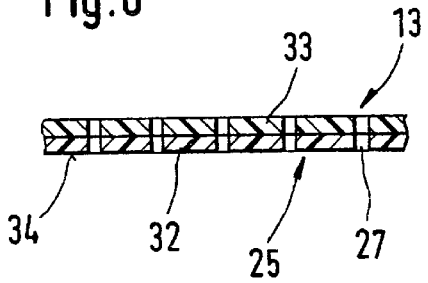
FIG. 8 is a greatly enlarged sectional lateral view of an apron similar to FIG. 6, wherein the apron comprises two layers.

The extruded plastic apron 25 (belt 13B) according to FIGS. 1 and 2B is shown in more detail in the FIGS. 6 to 8. As in particular can be seen in FIG. 8, the plastic belt 25 comprises two layers 32 and 33. The inner layer 32 should have a sufficiently smooth surface 34 and consists, for example, of polytetrafluor ethylene (PTFE). The outer layer, however, should be sufficiently stable in form, so that the drive by means of the above mentioned nipping roller 15 can occur from the outside.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An endless transport belt for transporting a fiber strand through a fiber bundling zone over a suction device with a suction slit facing the transport belt, wherein said transport belt includes a perforation pattern with plural perforations disposed laterally adjacent one another and extending in use over the suction slit, wherein the transport belt is one of a woven and a knitted sieve belt made of filaments, and wherein a clear width of holes forming the perforations between the filaments for suction air is less than 0.3 mm.

2. An endless transport belt according to claim 1, wherein the sieve belt is made from polyamide fiber filaments.

3. An endless transport belt according to claim 1, wherein the filaments have a diameter between 0.06 mm and 0.2 mm.

4. An endless transport belt according to claim 2, wherein the filaments have a diameter between 0.06 mm and 0.2 mm.

5. An endless transport belt according to claim 3, wherein the filaments have a diameter of less than 0.1 mm and wherein the clear width of the holes forming the perforations is less than 0.1 mm.

6. An endless transport belt according to claim 4, wherein the filaments have a diameter of less than 0.1 mm and wherein the clear width of the holes forming the perforations is less than 0.1 mm.

7. An endless transport belt according to claim 1, wherein the edges of the sieve belt are welded.

8. An endless transport belt according to claim 2, wherein the edges of the sieve belt are welded.

9. An endless transport belt according to claim 3, wherein the edges of the sieve belt are welded.

10. An endless transport belt according to claim 4, wherein the edges of the sieve belt are welded.

11. An endless transport belt according to claim 5, wherein the edges of the sieve belt are welded.

12. An endless transport belt according to claim 6, wherein the edges of the sieve belt are welded.

13. A method of making an endless transport belt for transporting a fiber strand through a fiber bundling zone over a suction device with a suction slit facing the transport belt, wherein said transport belt includes a perforation pattern with plural perforations disposed laterally adjacent one another and extending in use over the suction slit, wherein the transport belt is a sieve belt made of filaments, and wherein a clear width of holes forming the perforations between the filaments for suction air is less than 0.3 mm, said method comprising one of weaving and knitting the sieve belt.

14. A method according to claim 13, wherein said method comprises weaving the sieve belt.

15. A method according to claim 13, wherein said method comprises knitting the sieve belt.

16. A method according to claim 13, wherein the filaments are synthetic filaments.

17. A method according to claim 14, wherein the filaments are synthetic filaments.

18. A method according to claim 15, wherein the filaments are synthetic filaments.

* * * * *